US009474125B2

(12) United States Patent
Kim et al.

(10) Patent No.: US 9,474,125 B2
(45) Date of Patent: Oct. 18, 2016

(54) DISPLAY APPARATUS AND METHOD OF MANUFACTURING THE SAME

(71) Applicant: SAMSUNG DISPLAY CO., LTD., Yongin, Gyeonggi-Do (KR)

(72) Inventors: Seung Kim, Yongin (KR); Seungho Kim, Yongin (KR); Ikhyung Park, Yongin (KR); Jonghoon Yeum, Yongin (KR); Hoikwan Lee, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/670,680

(22) Filed: Mar. 27, 2015

(65) Prior Publication Data

US 2016/0037607 A1 Feb. 4, 2016

(30) Foreign Application Priority Data

Aug. 1, 2014 (KR) ..... 10-2014-0099245

(51) Int. Cl.

| | |
|---|---|
| ***H01J 1/62*** | (2006.01) |
| ***H05B 33/10*** | (2006.01) |
| ***H05B 33/20*** | (2006.01) |

(52) U.S. Cl.

CPC ..... *H05B 33/10* (2013.01); *H05B 33/20* (2013.01)

(58) Field of Classification Search

CPC ..... H05B 33/10; H05B 33/20
USPC ..... 313/512, 511, 498, 506
See application file for complete search history.

(56) References Cited

U.S. PATENT DOCUMENTS 6,567,077 B2 * 5/2003 Inoue ..... G06F 3/0436 178/18.01
2012/0168058 A1 7/2012 Kim et al.

FOREIGN PATENT DOCUMENTS

| | | | |
|---|---|---|---|
| JP | 06-312360 | A | 11/1994 |
| KR | 10-2010-0035598 | A | 4/2010 |
| KR | 10-2011-0030732 | A1 | 3/2011 |
| KR | 10-2011-0134207 | A | 12/2011 |

* cited by examiner

*Primary Examiner* — Vip Patel
(74) *Attorney, Agent, or Firm* — Lee & Morse, P.C.

(57) ABSTRACT

Provided are a display apparatus and a method of manufacturing the display apparatus. The display apparatus includes a first substrate that is curved; a display unit on the first substrate; and a second substrate that covers the display unit, is curved, and faces the first substrate, at least one selected from edges of the first substrate and edges of the second substrate being at least partially chamfered.

20 Claims, 6 Drawing Sheets

DISPLAY APPARATUS AND METHOD OF MANUFACTURING THE SAME

CROSS-REFERENCE TO RELATED APPLICATION

Korean Patent Application No. 10-2014-0099245, filed on Aug. 1, 2014, in the Korean Intellectual Property Office, and entitled: "Display Apparatus and Method of Manufacturing the Same," is incorporated by reference herein in its entirety.

BACKGROUND

1. Field

One or more embodiments relate to a display apparatus and a method of manufacturing the same.

2. Description of the Related Art

Electronic devices based on mobility may be used widely. Mobile electronic devices such as tablet person computers (PCs), as well as small electronic devices such as mobile phones, may be widely used.

SUMMARY

Embodiments may be realized by providing a display apparatus, including a first substrate that is curved; a display unit on the first substrate; and a second substrate that covers the display unit, is curved, and faces the first substrate, at least one selected from edges of the first substrate and edges of the second substrate being at least partially chamfered.

At least one of the first substrate and the second substrate may includes a first edge portion having a curvature; and a second edge portion connected to the first edge portion.

A first surface roughness of the first edge portion may be less than a second surface roughness of the second edge portion.

The first surface roughness may range from 0.05 μm to 0.8 μm.

The first surface roughness of the first edge portion may increase from a center portion of the first edge portion toward end portions of the first edge portion in a length direction.

At least one of the first substrate and the second substrate may be a curved surface having a plurality of radii of curvature or a constant radius of curvature.

Embodiments may be realized by providing a method of manufacturing a display apparatus, the method including attaching a second substrate to a first substrate on which a display unit is formed; cutting the first substrate and the second substrate to a predetermined size; chamfering at least one of a cut portion of the first substrate and a cut portion of the second substrate; and compressing the first substrate and the second substrate so that the first and second substrate have curvatures.

The method may further include, after chamfering at least one of the cut portion of the first substrate and the cut portion of the second substrate, polishing at least one of the cut portion of the first substrate and the cut portion of the second substrate.

Cutting the first substrate and the second substrate may include cutting the first substrate and the second substrate so that the first substrate and the second substrate each includes a first edge portion and a second edge portion connected to the first edge portion and having a length that is less than the first edge portion.

The chamfering may include chamfering the first edge portion and the second edge portion so that a first surface roughness of the first edge portion is less than a second surface roughness of the second edge portion.

The first surface roughness may range from 0.05 μm to 0.8 μm.

The chamfering may be performed so that the first surface roughness of the first edge portion increases from a center portion of the first edge portion toward end portions of the first edge portion in a length direction.

The chamfering may include grinding the first and second edge portions while moving a grinder that rotates, and a first velocity of the grinder when the grinder moves along the first edge portion may be less than a second velocity of the grinder when the grinder moves along the second edge portion.

The first velocity may increase as the grinder moves from the center portion of the first edge portion toward the end portions of the first edge portion.

Compressing the first and second substrates may include compressing the first and second substrates so that at least one of the first substrate and the second substrate is a curved surface having a plurality of radii of curvature or a constant curvature.

Embodiments may be realized by providing a method of manufacturing a display apparatus, the method including cutting a first substrate on which a display unit is formed, and cutting a second substrate to correspond to a size of the first substrate; chamfering at least one of a cut portion of the first substrate and a cut portion of the second substrate; attaching the second substrate to the first substrate; and compressing the first substrate and the second substrate so that the first substrate and the second substrate have curvatures.

The method may further include, after chamfering at least one of the cut portion of the first substrate and the cut portion of the second substrate, polishing at least one of the cut portion of the first substrate and the cut portion of the second substrate.

Cutting the first and second substrates may include cutting the first substrate and the second substrate so that the first substrate and the second substrate each includes a first edge portion and a second edge portion connected to the first edge portion and having a length that is less than the first edge portion.

The chamfering may include grinding the first and second edge portions while moving a grinder that rotates, and a first velocity of the grinder when the grinder moves along the first edge portion may be less than a second velocity of the grinder when the grinder moves along the second edge portion.

The first velocity may increase as the grinder moves from the center portion of the first edge portion toward the end portions of the first edge portion.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
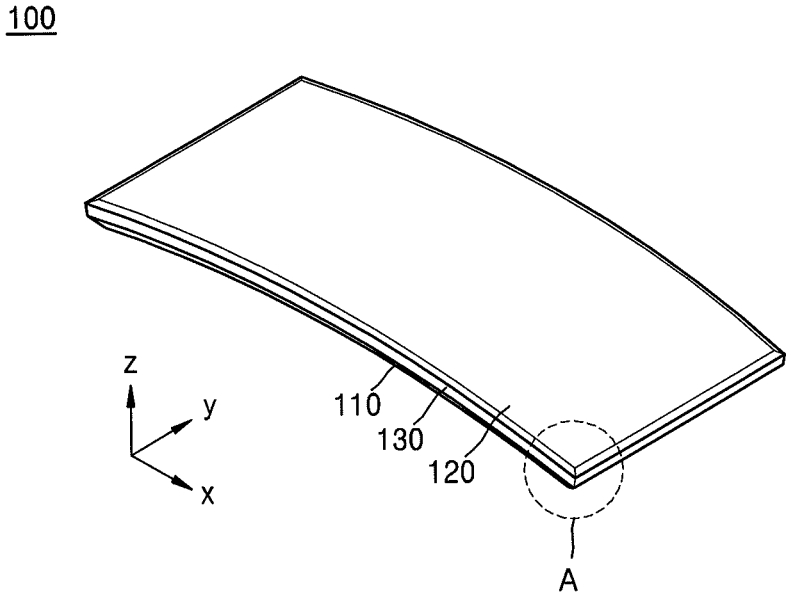
FIG. 1 illustrates a perspective view of a display apparatus according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Like reference numerals in the drawings denote like elements.

It will be understood that although the terms "first", "second", etc. may be used herein to describe various components, these components should not be limited by these terms. These components are only used to distinguish one component from another.

As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

It will be understood that when a layer, region, or component is referred to as being "formed on" another layer, region, or component, it can be directly or indirectly formed on the other layer, region, or component. That is, for example, intervening layers, regions, or components may be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

Sizes of components in the drawings may be exaggerated for convenience of explanation. In other words, since sizes and thicknesses of components in the drawings are arbitrarily illustrated for convenience of explanation, the following embodiments are not limited thereto.

In the following examples, the x-axis, the y-axis and the z-axis are not limited to three axes of the rectangular coordinate system, and may be interpreted in a broader sense. For example, the x-axis, the y-axis, and the z-axis may be perpendicular to one another, or may represent different directions that are not perpendicular to one another.

When a certain embodiment may be implemented differently, a specific process order may be performed differently from the described order. For example, two consecutively described processes may be performed substantially at the same time or performed in an order opposite to the described order. As used herein, the term "and/or" includes any and all combinations of one or more of the associated listed items. Expressions such as "at least one of," when preceding a list of elements, modify the entire list of elements and do not modify the individual elements of the list.

Figure 2:
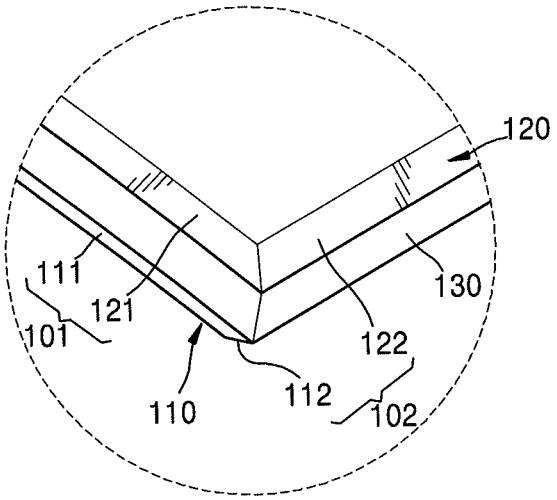
FIG. 2 illustrates a perspective view of an enlarged view of a region A of FIG. 1.

FIG. 1 illustrates a perspective view of a display apparatus 100 according to an embodiment, and FIG. 2 illustrates a perspective view of an enlarged view of a region A in FIG. 1. Referring to FIGS. 1 and 2, the display apparatus 100 may include a substrate 110, a second substrate 120, and a display unit 130.

The first substrate 110 may be formed of, for example, a transparent glass material mainly containing $SiO_2$. In an embodiment, the first substrate 110 may be formed of a transparent plastic material. The transparent plastic material for forming the first substrate 110 may be an organic insulating material, for example, an organic material selected from polyethersulphone (PES), polyacrylate (PAR), polyetherimide (PEI), polyethyelenen napthalate (PEN), polyethyeleneterepthalate (PET), polyphenylene sulfide (PPS), polyallylate, polyimide, polycarnonate (PC), cellulose triacetate (TAC), and cellulose acetate propionate (CAP).

The first substrate 110 may be formed of metal. The first substrate 110 may include one or more of, for example, carbon, iron, chrome, manganese, nickel, titanium, molybdenium, stainless steel (SUS), an Inval alloy, an inconel alloy, and a kovar alloy. The first substrate 110 may be formed of a metal foil.

The first substrate 110 may be formed as a curved surface having a plurality of radiuses of curvature. For example, the first substrate 110 may be formed to have a first curved surface having a first radius of curvature R1, a second curved surface having a second radius of curvature R2, and a third curved surface having a third radius of curvature R3 in a length direction or a width direction. The first substrate 110 may further include a plurality of curved surfaces having radiuses of curvature R4, R5, . . . , Rn (n is a natural number), in addition to the curved surfaces having the radiuses of curvature R1, R2, and R3.

In an embodiment, the first substrate 110 may be formed as a curved surface having a constant radius of curvature. For example, the first substrate 110 may be formed as a curved surface having a constant radius of curvature R. Hereinafter, a case in which the first substrate 110 is formed as the curved surface having the constant radius of curvature R will be described below for convenience of description.

The first substrate 110 is adhered to the second substrate 120 that is disposed on the display unit 130. The second substrate 120 may be formed of various plastic materials such as acryl, in addition to a glass material, and moreover, the second substrate 120 may be formed of a metal plate.

At least one selected from edges of the first substrate 110 and edges of the second substrate 120 may be chamfered in at least a part thereof. For example, a first edge portion 101 may include a 1-a edge portion 111 formed in the first substrate 110 to have a curvature and a 1-b edge portion 121 formed in the second substrate 120 to have a curvature. A second edge portion 102 may include a 2-a edge portion 112 formed in the first substrate 110 to have a curvature and a 2-b edge portion 122 formed in the second substrate 120 to have a curvature. The 1-a edge portion 111 and the 2-a edge portion 112 that are formed by polishing the first substrate 110 may have nearly the same shapes and effects as those of the 1-b edge portion 121 and the 2-b edge portion 122 formed by polishing the second substrate 120, and the 1-a edge portion 111 and the 2-a edge portion 112 will be described below.

At least a part of the edge portion of the first substrate 110 may be chamfered. The first substrate 110 may include the 1-a edge portion 111 formed to have a curvature and the 2-a edge portion 112 connected to the 1-a edge portion 111 and formed to be flat. Lengths of the 1-a edge portion 111 and the 2-a edge portion 112 are not limited to a certain range and a certain length ratio. A case in which the 1-a edge portion 111 has a longer length than that of the 2-a edge portion 112 will be described for convenience of description.

A first surface roughness of the 1-a edge portion 111 may be less than a second surface roughness of the 2-a edge portion 112. For example, the 1-a edge portion 111 and the 2-a edge portion 112 of the first substrate 110 may be chamfered, and a part of each edge portion 111 or 112 may form an inclined surface. The 1-a edge portion 111 may have the first surface roughness on the inclined surface, and the 2-a edge portion 112 may have the second surface roughness on the inclined surface.

The first surface roughness may be less than the second surface roughness, and the first substrate 110 may not be cracked or damaged when being compressed to be curved. When the first substrate 110 is compressed, the 1-a edge portion 111 may have a curvature and the 2-a edge portion 112 may be flat. A tensile stress may be concentrated on the 1-a edge portion 111 having the curvature, a compressive stress may be concentrated on the 2-a edge portion 112, and the 1-a edge portion 111 may be broken or cracked by an external force applied to the first substrate 110.

A velocity of a grinder (not shown) moving along the edge portion of the first substrate 110 when performing a chamfering operation may be changed, and the first surface roughness may be formed to be less than the second surface roughness. When chamfering the 1-a edge portion 111, the velocity of the grinder may be reduced less than that when chamfering the 2-a edge portion 112, and a grinding time may be increased. The 1-a edge portion 111 may be ground more accurately than the 2-a edge portion 112, and the first surface roughness may be less than the second surface roughness.

The first surface roughness may be 0.05 μm to 0.8 μm. If the first surface roughness is less than 0.05 μm, more time may be required for the chamfering process, and productivity may be reduced. If the first surface roughness is greater than 0.8 μm, a defect may occur when compressing the first substrate 110 for forming a curvature. To help provide a first surface roughness ranging from 0.05 μm to 0.8 μm, a polishing process may be additionally performed after performing the chamfering process of the 1-a edge portion 111.

The first surface roughness may increase from a center portion of the 1-a edge portion 111 to end portions of the 1-a edge portion 111 in a length direction. When the first substrate 110 is compressed for forming the curvature of the first substrate 110, a shearing stress may be concentrated on the center portion of the 1-a edge portion 111 at a maximum, and defects or damage on the first substrate 110 may occur. In an embodiment, the velocity of the grinder may be reduced at the center portion of the 1-a edge portion 111, and then, may be increased toward the end portions of the 1-a edge portion 111, the center portion of the 1-a edge portion 111 may be finely ground, and the first surface roughness may increase toward the end portions from the center portion of the 1-a edge portion 111.

The display unit 130 may be disposed between the first substrate 110 and the second substrate 120. The display unit 130 may include a flexible liquid crystal display (LCD) layer or an organic light emitting device (OLED).

If the display apparatus 100 is an LCD apparatus, the display unit 130 may include a LCD. The first substrate 110 may be an array substrate and the second substrate 120 may be a color filter substrate. The LCD may be injected into the array substrate and the color filter substrate to form the LCD apparatus. Descriptions of the array substrate, the color filter substrate, and the LCD are omitted.

Figure 3:
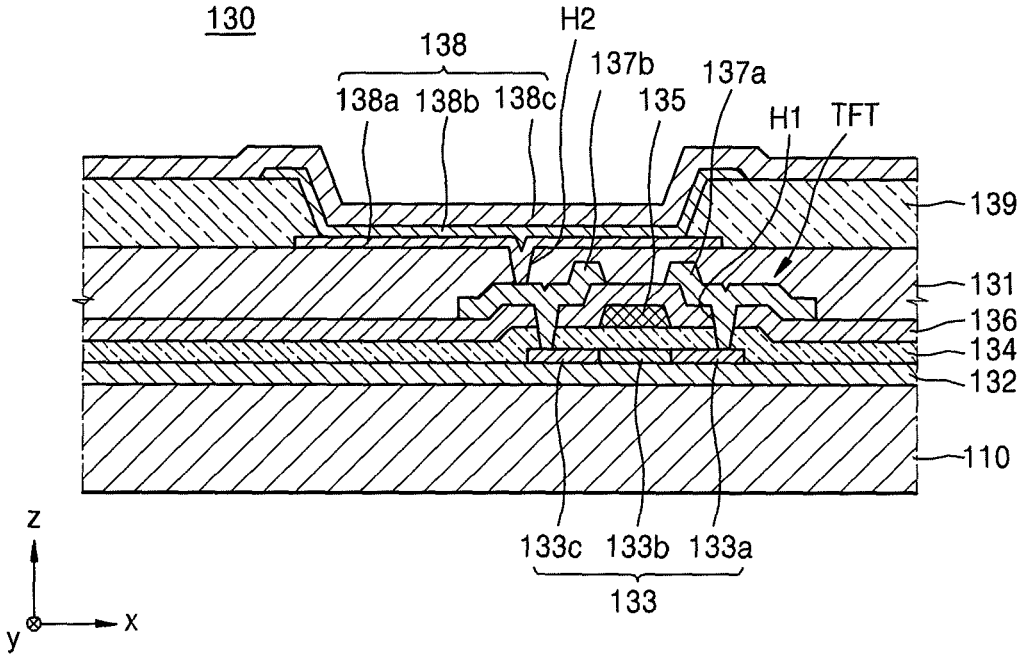
FIG. 3 illustrates a cross-sectional view of an organic light emitting device (OLED) of FIG. 1.

FIG. 3 illustrates a cross-sectional view of an OLED of FIG. 1. Referring to FIG. 3, a structure in which the display apparatus 100 includes an OLED as the display unit 130 will be described below.

If the display apparatus 100 is an organic light emitting display apparatus, the display unit 130 may include an OLED.

A buffer layer 132 formed of an organic compound and/or an inorganic compound may be further formed on an upper surface of the substrate 110, for example, the buffer layer 132 may be formed of SiOx (x≥1) or SiNx (x≥1).

An active layer 133 may be arranged on the buffer layer 132 in a predetermined pattern, and then, may be embedded by the gate insulating layer 134. The active layer 133 may include a source region 133*a* and a drain region 133*c*, and a channel region 133*b* between the source and drain regions 133*a* and 133*c*.

The active layer 133 may be formed to include various materials. For example, the active layer 133 may include an inorganic semiconductor material such as amorphous silicon or crystalline silicon. As another example, the active layer 133 may include oxide semiconductor. As another example, the active layer 133 may include an organic semiconductor material. Hereinafter, a case in which the active layer 133 is formed of amorphous silicon will be described for convenience of description.

The active layer 133 may be formed by forming an amorphous silicon layer on the buffer layer 132, crystallizing the amorphous silicon layer into a polycrystalline silicon layer, and patterning the polycrystalline silicon layer. In the active layer 133, the source region 133*a* and the drain region 133*c* are doped with impurities according to a kind of thin film transistor (TFT), for example, a driving TFT (not shown) or a switching TFT (not shown).

A gate electrode 135 corresponding to the active layer 133 and an interlayer insulating layer 136 embedding the gate electrode 135 are formed on an upper surface of the gate insulating layer 134.

After forming contact holes in the interlayer insulating layer 136 and the gate insulating layer 134, a source electrode 137*a* and a drain electrode 137*b* are formed on the interlayer insulating layer 136 to contact the source region 133*a* and the drain region 133*c*, respectively.

A passivation layer 131 is formed on the above resultant (TFT), and a pixel electrode 138*a* of the OLED is formed on the passivation layer 131. The pixel electrode 138*a* contacts the drain electrode 137*b* of the TFT via a via hole H2 formed in the passivation layer 131. The passivation layer 131 may be formed to have a single-layered or multi-layered structure including an organic material and/or an inorganic material. The passivation layer 131 may be formed as a planarization layer for providing a flat upper surface. In an embodiment, the passivation layer 131 may be formed along with an irregular surface of a lower layer. The passivation layer 131 may be formed of a transparent insulating material for achieving a resonant effect.

After forming the pixel electrode 138*a* on the passivation layer 131, a pixel defining layer 139 is formed of an organic material and/or an inorganic material, and the pixel electrode 138*a* and the passivation layer 131 may be covered. An opening exposing the pixel electrode 138*a* is formed.

An intermediate layer 138*b* and an opposite electrode 138*c* are formed at least on the pixel electrode 138*a*.

The pixel electrode 138*a* may function as an anode electrode and the opposite electrode 138*c* may function as a cathode electrode, or vice versa.

The pixel electrode 138*a* and the opposite electrode 138*c* may be insulated from each other by the intermediate layer 138*b*, and apply voltages of different polarities to the intermediate layer 138*b*, and an organic emission layer may emit light.

The intermediate layer 138*b* may include the organic emission layer. As another alternative example, the intermediate layer 138*b* may include the organic emission layer, and then, may further include at least one of a hole injection layer (HIL), a hole transport layer (HTL), an electron transport layer (ETL), and an electron injection layer (EIL). In an embodiment, the intermediate layer 138*b* may include the organic emission layer, and may further include various other functional layers.

One unit pixel may include a plurality of sub-pixels, and each may emit light of various colors. For example, the plurality of sub-pixels may respectively emit red, green, and blue light, or may emit red, green, blue, and white light.

Each of the plurality of sub-pixels may include the intermediate layer 138*b* including the organic emission layer that may emit light of various colors. For example, the plurality of sub-pixels may include the intermediate layers 138*b* respectively including the organic emission layers emitting the red, green, and blue light.

As another example, the plurality of sub-pixels emitting the light of various colors may include the intermediate layers 138*b* that include the organic emission layers emitting the same color light, for example, white light, and each of the sub-pixels may include a color converting layer or a color filter for changing the white light into the light of another color.

The intermediate layer 138*b* emitting white light may have various structures, for example, the intermediate layer 138*b* may have a structure, in which at least a light emitting material emitting red light, a light emitting material emitting green light, and a light emitting material emitting blue light are stacked.

As another example of emitting the white light, the intermediate layer 138*b* may have a structure, in which at least the light emitting material emitting red light, the light emitting material emitting green light, and the light emitting material emitting blue light are mixed.

The red light, the green light, and the blue light are examples. In an embodiment, combination of other various colors, besides the red, green, and blue combination, may be used as long as the combination emits the white light.

A thin film encapsulation layer (not shown) may be formed on an upper portion of the display unit 130 to protect the display unit 130. The thin film encapsulation layer (not shown) may be formed as a thin film, and may include a plurality of inorganic layers or inorganic and organic layers.

The organic layer in the thin film encapsulation layer may be formed of polymer, for example, may be a single layer or a stacked layer formed of one selected from PET, polyimide, PC, epoxy, polyethylene, and polyacrylate. In an embodiment, the organic layer may be formed of polyacrylate, for example, a polymerized monomer composition including diacrylate-based monomer and triacrylate-based monomer. The monomer composition may further include monoacrylate-based monomer. The monomer composition may further include a photoinitiator such as, for example, trimethyl benzoyl diphenyl phosphine oxide (TPO).

The inorganic layer of the thin film encapsulation layer may be a single layer or a layer stack including a metal oxide or a metal nitride. The inorganic layer may include, for example, one of SiNx, $Al_2O_3$, $SiO_2$, and $TiO_2$.

The top layer of the thin film encapsulation layer that is exposed to the outside may be formed of an inorganic layer, and may help prevent the intrusion of moisture into the OLED.

The thin film encapsulation layer may include at least one sandwich structure in which at least one organic layer is inserted between at least two inorganic layers. In another example, the thin film encapsulation layer may include at least one sandwich structure in which at least one inorganic layer is inserted between at least two organic layers. In another example, the thin film encapsulation layer may include a sandwich structure in which at least one organic layer is inserted between at least two inorganic layers and a sandwich structure in which at least one inorganic layer is inserted between at least two organic layers.

The thin film encapsulation layer may include a first inorganic layer, a first organic layer, and a second inorganic layer that are sequentially formed from the top portion of the OLED.

In another example, the thin film encapsulation layer may include a first inorganic layer, a first organic layer, a second inorganic layer, a second organic layer, and a third inorganic layer that are sequentially formed from the top portion of the OLED.

In another example, the thin film encapsulation layer may include a first inorganic layer, a first organic layer, a second inorganic layer, a second organic layer, a third inorganic layer, a third organic layer, and a fourth inorganic layer that are sequentially formed from the top portion of the OLED.

A halogenated metal layer including LiF may be additionally included between the OLED and the first inorganic layer. The halogenated metal layer may help prevent the OLED from being damaged when the first inorganic layer is formed by a sputtering method.

The first organic layer may be smaller than the second inorganic layer, and the second organic layer may be smaller than the third inorganic layer.

In another example, the first organic layer may be completely covered by the second inorganic layer, and the second organic layer may be completely covered by the third inorganic layer.

Figure 4:
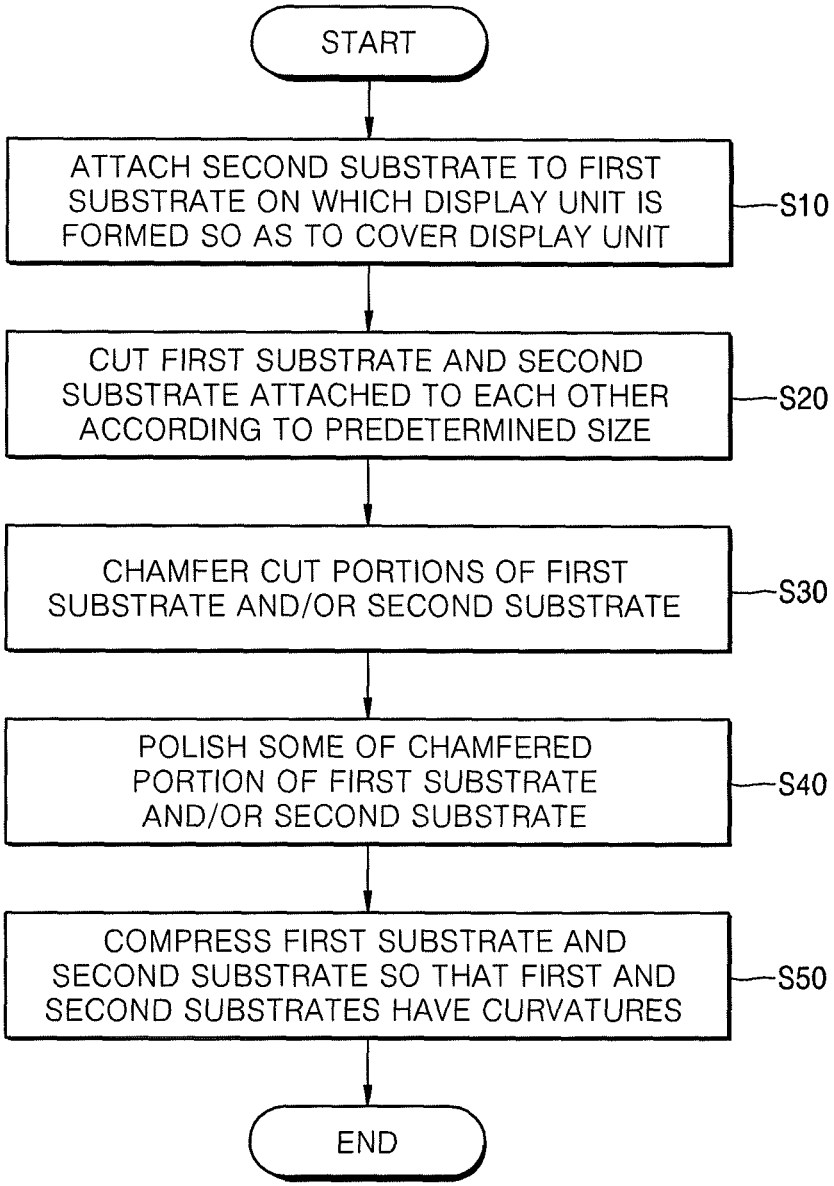
FIG. 4 illustrates a flowchart of a method of manufacturing a display apparatus according to another embodiment.

FIG. 4 illustrates a flowchart of a method of manufacturing a display apparatus according to an embodiment. Referring to FIG. 4, the second substrate 120 may be attached to the first substrate 110 on which the display unit 130 is formed so as to cover the display unit 130 (S10). The display apparatus 100 may be formed by cutting a display panel to which a large mother substrate (not shown) may be attached. The second substrate 120 may be attached to the first substrate 110 on which the display unit 130 may be formed by using a sealing member, or a thin film encapsulation structure may be formed on the first substrate 110 on which the display unit 130 may be formed to form the display panel.

The attached first substrate 110 and the second substrate 120 may be cut according to a predetermined size (S20). The display panel in which the first and second substrates 110 and 120 are attached may be cut according to the predetermined size by using a cutting device (not shown).

Through the process of cutting the first and second substrates 110 and 120, the first substrate 110 may have the 1-a edge portion 111 and the 2-a edge portion 112 having a shorter length than that of the 1-a edge portion 111. The second substrate 120 may have the 1-b edge portion 121 and the 2-b edge portion 122 having a shorter length than that of the 1-b edge portion 121. The 1-a edge portion 111 and the 2-a edge portion 112 formed by grinding the first substrate 110 may have the same shapes and effects as those of the 1-b edge portion 121 and the 2-b edge portion 122 formed by grinding the second substrate 120, and hereinafter the 1-a edge portion 111 and the 2-a edge portion 112 will be described below.

Cut portions of the first substrate 110 and/or the second substrate 120 may be chamfered (S30). The chamfering operation may form the first edge portion 101 and the second edge portion 102 while moving a rotating grinder. When the above display panel is cut, cut surfaces of the first substrate 120 and the second substrate 120 may protrude, and reliability of the product may be degraded. When the first and second substrates 110 and 120 are compressed for forming the curvature, one or more cracks may occur in the cut surfaces and a defect may occur.

Through the chamfering operation, the 1-a edge portion 111 and the 2-a edge portion 112 may have different surface roughness from each other. The first surface roughness of the 1-a edge portion 111 may be less than the second surface roughness of the second edge portion 102. The grinder may move slower when chamfering the 1-a edge portion 111 than when chamfering the 2-a edge portion 112. The chamfering operation is performed while moving the rotating grinder along the cut surfaces of the first substrate 110. The grinder may lineally move on the 1-a edge portion 111 slower than on the 2-a edge portion 112, the 1-a edge portion 111 may be ground finely, and the first surface roughness of the 1-a edge portion 111 may be less than the second surface roughness of the 2-a edge portion 112. The first surface roughness may range from 0.3 μm to 0.8 μm.

The first surface roughness of the 1-a edge portion 111 may increase from the center portion of the 1-a edge portion 111 toward end portions of the 1-a edge portion 111 in a length direction. The velocity of the grinder may become faster from the center portion of the 1-a edge portion 111 toward the end portions of the 1-a edge portion 111 while performing the grinding operation, the center portion of the 1-a edge portion 111 may be ground more precisely than at the end portions of the 1-a edge portion 111, and the first surface roughness of the 1-a edge portion 111 may gradually increase toward the end portions of the 1-a edge portion 111.

After chamfering the edge portions of the first substrate 110 and/or second substrate 120, a process of polishing the edge portions of the first substrate 110 and/or the second substrate 120 may be additionally performed (S40). The polishing process may be performed using an abrasive including ultrafine grains, or by using a polisher having a larger number of meshes than that of the grinder that is used in the chamfering process. The surface roughness of the edge portions may be further reduced through the polishing process. For example, the center portion of the 1-a edge portion 111 may be damaged in a curvature forming process that will be described later, and the surface roughness may be locally reduced by performing the polishing process on the 1-a edge portion 111. For example, the surface roughness at the center portion of the 1-a edge portion 111 may range from 0.05 μm to 0.3 μm, deformation and damage on the first substrate 110 may be reduced when making the first substrate 110 curved, and a high quality product may be manufactured.

The first and second substrates 110 and 120 are compressed to form curvatures of the first and second substrates 110 and 120 (S50). The first and second substrates 110 and 120 may be compressed by a lamination device (not shown), and at least one of the first and second substrates 110 and 120 may be formed as a curved surface having a plurality of radiuses of curvature or a constant radius of curvature.

According to the above method of manufacturing the display apparatus 100, the surface roughness of the 1-a edge portion 111 on which the curvature is formed may be reduced, and durability of the display apparatus 100 may be increased when curving the display apparatus 100.

The above method of manufacturing the display apparatus 100 may differentiate a time of performing the chamfering process according to the stress generated when forming the curvature, manufacturing time of the display apparatus 100 may be reduced, and durability of the display apparatus 100 may be increased.

A method of manufacturing the display apparatus 100 according to another embodiment is as follows.

The first substrate 110 on which the display unit 130 is formed is cut according to a predetermined size, and the second substrate 120 may be cut to correspond to the size of the first substrate 110. The cut portions of the first substrate 110 and/or the second substrate 120 may be chamfered. The second substrate 120 may be attached to the first substrate 110, and the display unit 130 may be covered. The first and second substrates 110 and 120 are compressed, and the first and second substrates 110 and 120 may have curvatures.

Cutting and chamfering of the first and second substrates 110 and 120 are performed first, and then, the first and second substrates 110 and 120 that are cut are attached to each other to form the display apparatus 100. Since the substrate is cut or chamfered before manufacturing an encapsulated substrate, a defect rate of the product may be reduced, and productivity may be increased.

Figure 5:
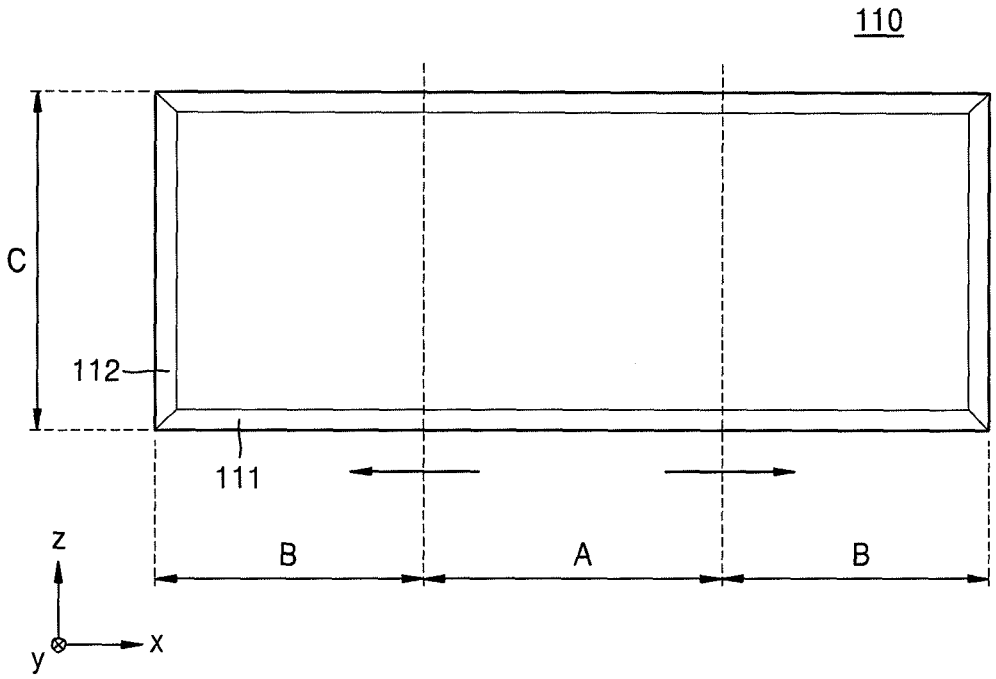
FIG. 5 illustrates a rear view of the display apparatus of FIG. 1.
Figure 6:
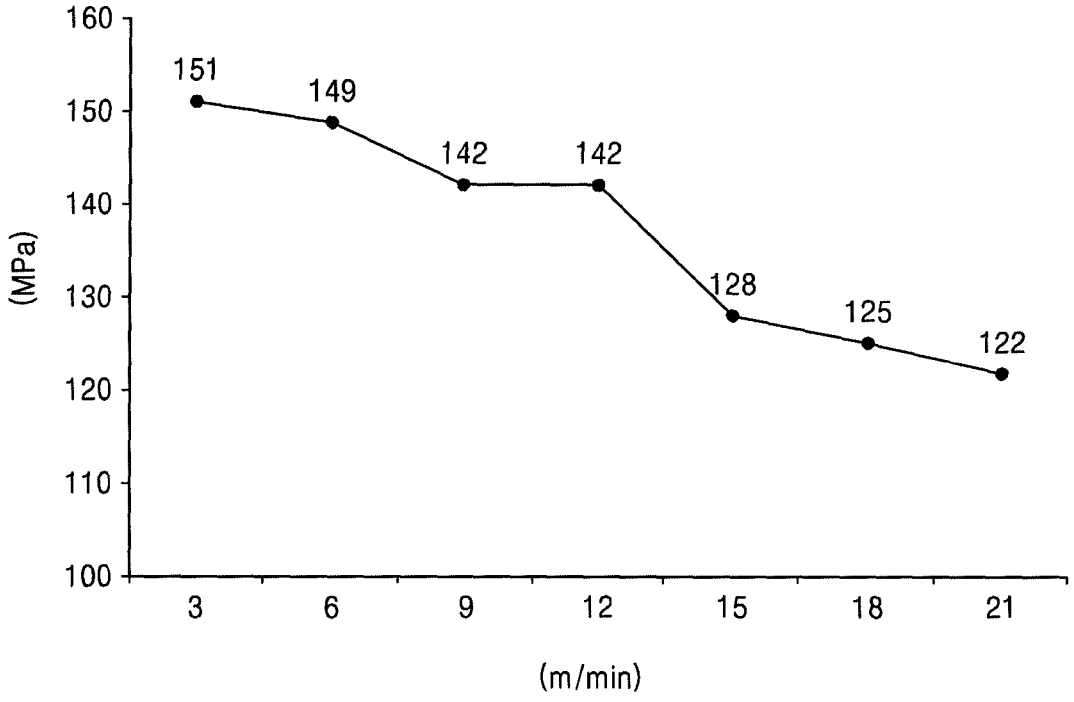
FIG. 6 illustrates a graph of a variation in strength of the display apparatus of FIG. 1 according to a speed of processing a boundary portion of the display apparatus.

FIG. 5 illustrates a rear view of the display apparatus 100 of FIG. 1, and FIG. 6 illustrates a graph of a variation in strength of the display apparatus 100 according to a processing speed of the edge portion of the display apparatus 100. Referring to FIGS. 5 and 6, a velocity of the grinder may be adjusted during the chamfering process, and productivity and strength of the display apparatus 100 may be improved.

In the display apparatus 100, in which size ratio between the first edge portion 101 and the second edge portion 102 is 16:9, the velocity of the grinder may be adjusted when chamfering each of the edges. The 1-a edge portion 111 may be divided into three parts, for example, the center portion (region A) and the end portions (region B). The 2-a edge portion 112 may be defined as a region C.

In FIG. 6, an X-axis denotes the velocity of the grinder that moves along the 1-a edge portion 111 in the region A, and a Y-axis denotes rigidity of the first substrate 110 represented in a unit of Mpa. After chamfering the edges with each velocity in the X-axis, the substrate 110 was compressed, and then, magnitude of pressure when the substrate was cracked or damaged is shown.

The process was performed at a revolution speed of 8000 RPM after mounting a diamond wheel of 600 meshes in the grinder. The velocity of the grinder moving along the edge portion of the first substrate 110 was adjusted in the region A. The rigidity of the first substrate 110 increases when the velocity of the grinder is reduced. When the velocity of the grinder is reduced, the chamfering may be performed more precisely, and the rigidity of the first substrate 110 may be increased.

In the substrate having the curvature, the tensile stress increases at a curved portion and the compressive stress increases at an opposite side. Referring back to FIG. 1, the tensile stress increases on the 1-a edge portion 111 having the curvature, and the compressive stress increases on the 2-a edge portion 112 that is flat. For example, the tensile stress may be the highest at the center portion of the 1-a edge portion 111. When the tensile stress increases, damage of the material may occur, and reliability of the product may be degraded.

The portion where the tensile stress is concentrated may be precisely processed to reduce the surface roughness, and the rigidity of the display apparatus 100 may be improved. The processing speed may be increased on the portion where the compressive stress is concentrated to reduce a processing time (tack time), and productivity may be improved.

By way of summation and review, a mobile electronic device may include a display apparatus providing a user with visual information such as images or videos, to support various functions. The display apparatus may have various structures according to needs of customers.

As components for driving a display apparatus are reduced in size, the display apparatus may become important in electronic devices. A display apparatus may be curved to have a predetermined angle from a flat status. For example, a display apparatus that is curved may increase a user's immersion into displayed images and may increase design value of a product.

To manufacture a display apparatus with a curvature, a flat material may be compressed to deform the flat material and generate a curvature. The flat material may be damaged or a defect may occur in the flat material during compression due to the physical characteristics of the flat material. Generating the curvature of a display apparatus within a physically or chemically stable range may help provide a method with improved reliability.

As described above, according to the one or more of the above embodiments, the display apparatus and the method of manufacturing the display apparatus may improve durability of the display apparatus.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display apparatus, comprising:

a first substrate that is curved;

a display unit on the first substrate; and a second substrate that covers the display unit, is curved, and faces the first substrate, one or more of edges of the first substrate or edges of the second substrate being at least partially chamfered.

2. The display apparatus as claimed in claim 1, wherein at least one of the first substrate and the second substrate includes:

a first edge portion having a curvature; and a second edge portion connected to the first edge portion.

3. The display apparatus as claimed in claim 2, wherein a first surface roughness of the first edge portion is less than a second surface roughness of the second edge portion.

4. The display apparatus as claimed in claim 3, wherein the first surface roughness ranges from 0.05 μm to 0.8 μm.

5. The display apparatus as claimed in claim 3, wherein the first surface roughness of the first edge portion increases from a center portion of the first edge portion toward end portions of the first edge portion in a length direction.

6. The display apparatus as claimed in claim 1, wherein at least one of the first substrate and the second substrate is a curved surface having a plurality of radii of curvature or a constant radius of curvature.

7. A method of manufacturing a display apparatus, the method comprising:

attaching a second substrate to a first substrate on which a display unit is formed;

cutting the first substrate and the second substrate to a predetermined size;

chamfering one or more of a cut portion of the first substrate or a cut portion of the second substrate; and compressing the first substrate and the second substrate so that the first and second substrate have curvatures.

8. The method as claimed in claim 7, further comprising, after chamfering at least one of the cut portion of the first substrate and the cut portion of the second substrate, polishing at least one of the cut portion of the first substrate and the cut portion of the second substrate.

9. The method as claimed in claim 7, wherein cutting the first substrate and the second substrate includes cutting the first substrate and the second substrate so that the first substrate and the second substrate each includes a first edge portion and a second edge portion connected to the first edge portion and having a length that is less than the first edge portion.

10. The method as claimed in claim 9, wherein the chamfering includes chamfering the first edge portion and the second edge portion so that a first surface roughness of the first edge portion is less than a second surface roughness of the second edge portion.

11. The method as claimed in claim 10, wherein the first surface roughness ranges from 0.05 μm to 0.8 μm.

12. The method as claimed in claim 10, wherein the chamfering is performed so that the first surface roughness of the first edge portion increases from a center portion of the first edge portion toward end portions of the first edge portion in a length direction.

13. The method as claimed in claim 12, wherein the chamfering includes grinding the first and second edge portions while moving a grinder that rotates, and a first velocity of the grinder when the grinder moves along the first edge portion is less than a second velocity of the grinder when the grinder moves along the second edge portion.

14. The method as claimed in claim 13, wherein the first velocity increases as the grinder moves from the center portion of the first edge portion toward the end portions of the first edge portion.

15. The method as claimed in claim 7, wherein compressing the first and second substrates includes compressing the first and second substrates so that at least one of the first substrate and the second substrate is a curved surface having a plurality of radii of curvature or a constant curvature.

16. A method of manufacturing a display apparatus, the method comprising:

cutting a first substrate on which a display unit is formed, and cutting a second substrate to correspond to a size of the first substrate;

chamfering one or more of a cut portion of the first substrate or a cut portion of the second substrate;

attaching the second substrate to the first substrate; and compressing the first substrate and the second substrate so that the first substrate and the second substrate have curvatures.

17. The method as claimed in claim 16, further comprising, after chamfering at least one of the cut portion of the first substrate and the cut portion of the second substrate, polishing at least one of the cut portion of the first substrate and the cut portion of the second substrate.

18. The method as claimed in claim 16, wherein cutting the first and second substrates includes cutting the first substrate and the second substrate so that the first substrate and the second substrate each includes a first edge portion and a second edge portion connected to the first edge portion and having a length that is less than the first edge portion.

19. The method as claimed in claim 18, wherein the chamfering includes grinding the first and second edge portions while moving a grinder that rotates, and a first velocity of the grinder when the grinder moves along the first edge portion is less than a second velocity of the grinder when the grinder moves along the second edge portion.

20. The method as claimed in claim 19, wherein the first velocity increases as the grinder moves from a center portion of the first edge portion toward end portions of the first edge portion.

* * * * *